US006991488B2

(12) United States Patent
Freakes

(10) Patent No.: US 6,991,488 B2
(45) Date of Patent: Jan. 31, 2006

(54) ELECTRICAL CONNECTOR DEVICES AND METHODS FOR EMPLOYING SAME

(76) Inventor: Anthony Freakes, 207 Park Ave., Leonia, NJ (US) 07605

( * ) Notice: Subject to any disclaimer, the term of this patent is extended or adjusted under 35 U.S.C. 154(b) by 30 days.

(21) Appl. No.: 10/671,283

(22) Filed: Sep. 25, 2003

(65) Prior Publication Data

US 2004/0097125 A1 May 20, 2004

Related U.S. Application Data

(60) Provisional application No. 60/413,362, filed on Sep. 25, 2002.

(51) Int. Cl.
*H01R 11/20* (2006.01)

(52) U.S. Cl. ..... 439/402; 439/885; 439/404; 439/413

(58) Field of Classification Search ..... 439/402, 439/400, 395, 714
See application file for complete search history.

(56) References Cited

U.S. PATENT DOCUMENTS

| | | | | | |
|---|---|---|---|---|---|
| 4,169,646 | A | * | 10/1979 | Stape et al. | 439/397 |
| 4,350,405 | A | * | 9/1982 | Yapoudjian et al. | 439/402 |
| 5,727,967 | A | * | 3/1998 | Chen | 439/418 |
| 5,759,061 | A | * | 6/1998 | Jensen et al. | 439/402 |
| 5,853,703 | A | | 12/1998 | Cerami et al. | 424/53 |
| 5,889,032 | A | | 3/1999 | Lohray et al. | 514/369 |

* cited by examiner

*Primary Examiner*—Truc Nguyen
(74) *Attorney, Agent, or Firm*—Kaplan Gilman Gibson & Dernier LLP

(57) ABSTRACT

An electrical connector for connecting two or more wires together electrically, having wire slots are oriented in a direction substantially parallel to each other, facilitating the use of only one operation to connect all wires; also retaining a terminated wires. Also methods for producing such connector, minimizing waste of production material, using such connector and configuring such connector at small dimensions and tolerances.

32 Claims, 13 Drawing Sheets

ELECTRICAL CONNECTOR DEVICES AND METHODS FOR EMPLOYING SAME

This application claims the benefit of U.S. Provisional Patent Application Ser. No. 60/413,362, filed Sep. 25, 2002.

BACKGROUND OF THE INVENTION

Magnet wire is a single strand wire is typically used whenever a coil is built, and in a variety of other applications. Typically it is covered by a relatively thin film of insulation, which serves to insulate the wire from adjacent wires. Magnet wire can be very thin, ranging in diameter to 0.010", if not even thinner.

Lead wire is used to convey larger amounts of electricity over longer distances, such as from a power source to a coil. A lead wire is typically a multi-strand conductor for flexibility and is covered by a relatively thick layer of insulation. A standard configuration for lead wire is 10 conductor strands, each measuring 0.010" diameter, and covered by insulation. The entire lead wire typically has a diameter of about 0.100".

Bare wire is among the most basic of wires. It is merely a single strand conductor with no insulation surrounding it. Bare wire is also used as the lead wire to electronic components. It can also be very thin.

Many methods are known to connect wires together. Among these are splicing by solder, splicing by clip; splicing by mechanical clamp, etc. Other known methods employ indirect connection, whereby an intermediary conductive piece is introduced between, and connected to, each wire.

Particular examples of the intermediate piece employment can be seen in coils where the plastic bobbin upon which the coil is wound has built-in pockets for receiving insulation displacing connectors.

Insulation displacing connectors avoid the necessity of pre-stripping the insulation from the conductors. Instead, the insulation is cut and moved away sufficiently from the connector so that electrical contact is made between the connector and the internal wire conductor. This is often done in one simple stroke.

Products supplied by Tyco International called "Magmate," "Siameze" and "Leadloc" are examples of applications of connecting magnet wire to lead wire.

However, these products are designed so that they connect to the magnet wire either before of after connecting to the lead wire. This means that there are multiple operations. Also, the "Leadloc" product contains more than one part. It uses an additional component to retain the lead wire.

Also, products such as these are limited in how well they make a mechanical and electrical connection with a wire. They are further limited in this area by the diameter of the wire being connected. The smaller the wire, the lower the probability that an effective, gas tight connection will be made.

SUMMARY OF THE INVENTION

It is an object of the present invention to provide an electrical connector that will establish an effective, gas tight electrical connection between the connector and a wire.

It is another object of the present invention to provide an electrical connector that can connect two or more wires in one operation.

It is another object of the present invention to provide an electrical connector that connects at least two wires and is configured to retain and entrap said wires without need for an additional retaining component.

It is yet another object of the present invention to provide a method for producing an electrical connector that will establish a effective, gas tight electrical connection between the connector and a smaller diameter wire that is superior to connector produced using only die stamping methods.

It is still another object of the present invention to provide an electrical connector that will adequately and consistently displace the insulation surrounding the wire to provide an effective, gas tight electrical connection between the connector and a wire.

It is yet still another object of the present invention to provide an electrical connector that will aid in the retention of the wire to the connector.

It is a further object of the present invention to provide an electrical connector that will aid in the retention of the connector to an outside mounting medium.

It is yet a further object of the present invention to provide an electrical connector that will resist deformation and overinsertion into an outside mounting medium.

It is also former an object of the present invention to provide a method for minimizing swelling caused by rounding slot walls in an electrical connector of a small dimension using a radius.

The present invention provides an electrical connector for connecting two or more wires together electrically, where the wire slots are oriented in a direction substantially parallel to each other. This facilitates the use of only one operation to connect all wires. This significantly improves productivity by reducing the number of operations required to connect wires together, and significantly reduces the cost and amount of capital equipment required for such connection process. The present invention also naturally traps a terminated wire in its slot, thereby eliminating the need for an additional wire termination or a wire staple. This provides a substantial cost reduction. The slots of the present invention can be configured to connect magnet wire to magnet wire, lead wire to lead wire, component lead to magnet wire, component lead to lead wire or other combinations. Also, the present invention contemplate in one embodiment could more than two slots for connecting additional items in a simultaneous manner.

The connector of the present invention can be made as part of a continuous strip of material. Indentations can be made to facilitate a scrapless separation of each connector from said strip during application, thereby eliminating the problems of scrap piece control and removal.

Further, the present invention also comprises a method for minimizing swelling, and resulting connector distortion, caused by rounding slot walls of the electrical connector to facilitate easy wire insertion and eliminate potentially destructive sharp ends.

The present invention also provides specific blade and cavity configurations that allow for the displacement of insulating material from a connected wire, to provide an effective, gas tight mechanical and electrical connection, prevent inadvertent wire removal and prevent distortion of the connector.

The present invention also further provides a method of manipulating blades to achieve an effective, gas tight mechanical and electrical connection based upon a spring load; and to allow the slots to accept wire of smaller diameter than has been heretofore economically practicable.

The present invention still further provides electrical connectors adapted for attachment to a printed circuit board.

DETAILED DESCRIPTION OF THE PREFERRED EMBODIMENT

Figure 1:
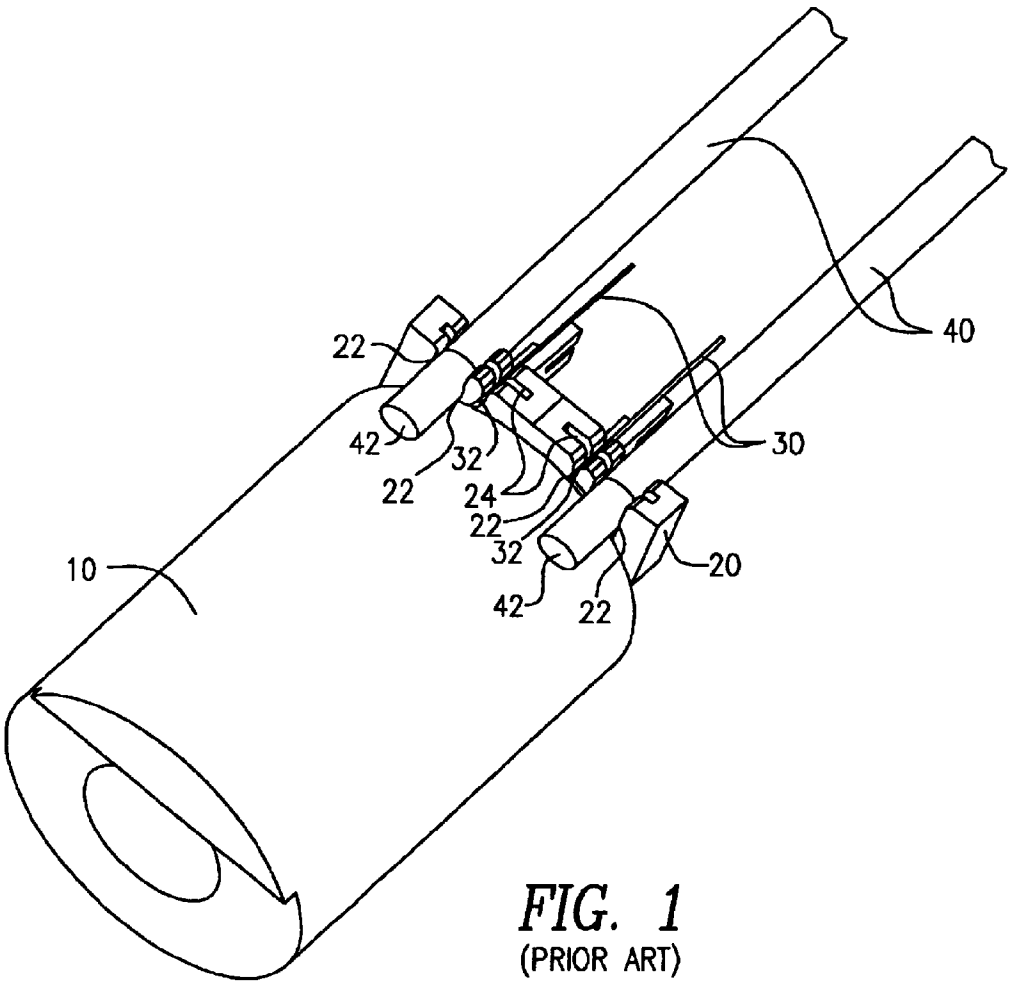
FIG. 1 (PRIOR ART)
FIG. 1 is a top perspective view of a prior art coil and coil bobbin with lead wires and magnet wires to which the teachings of the present invention may be applied.
Figure 3:
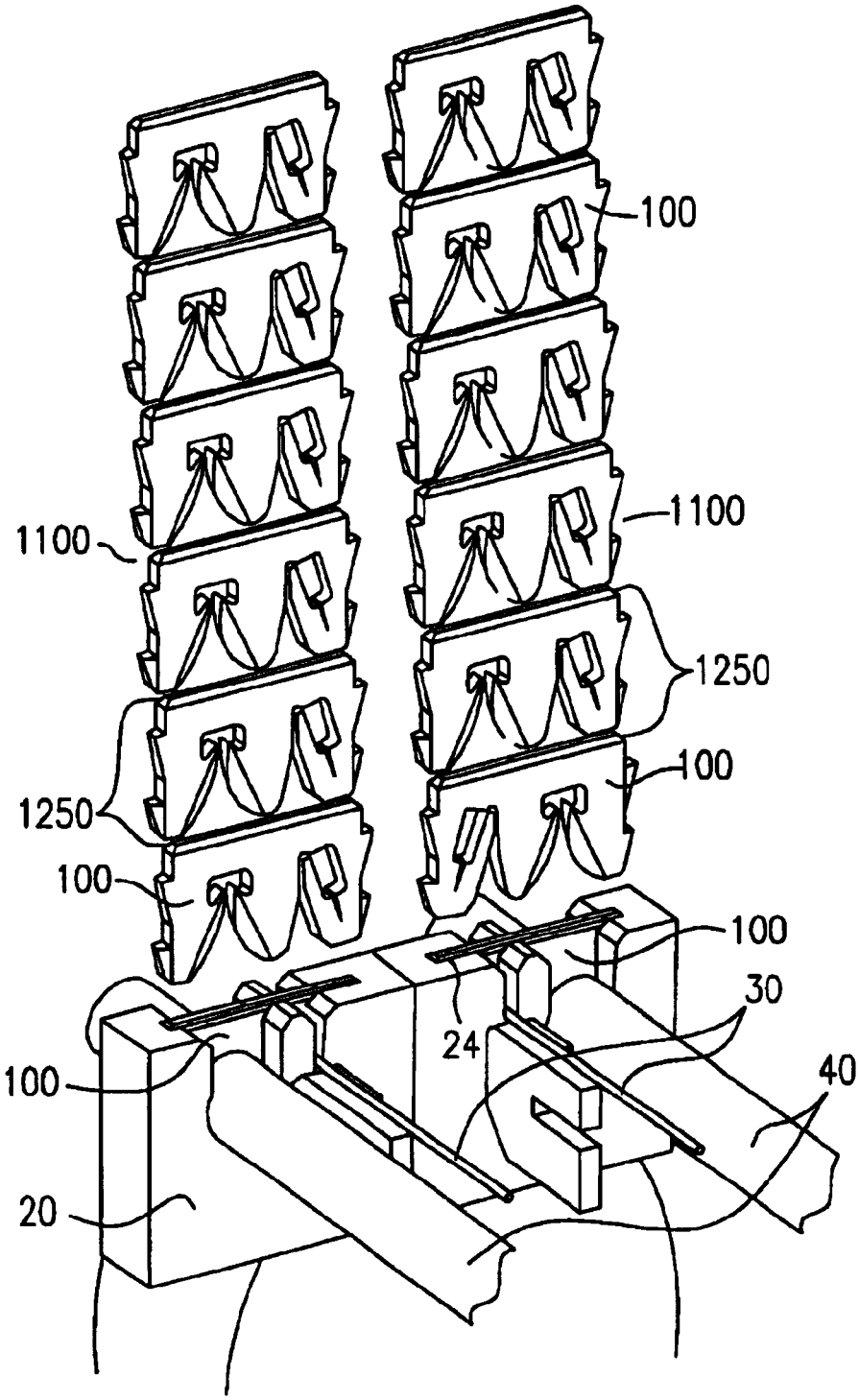
FIG. 3 is a front perspective view of a plurality of electrical connectors according to a preferred embodiment of the present invention applied to a coil and coil bobbin with lead wires and magnet wires according to one method of the present invention.

FIG. 1 is a representation of a simple coil 10 wound on a bobbin 20. Bobbin 20 further comprises integrated pockets 22 and slots 24. The ends 32 of the magnet wire 30 winding are pre-positioned and anchored in their appropriate slots 24. The ends 42 of the lead wires 40 are also pre-positioned in their slots 24. Slots 24 hold the wires in exact positions across pockets 22. Pockets 22 are adapted to support the wires while a connector 100 is introduced into them, as illustrated in FIG. 3.

Electrical connector 100 is preferably a planar piece of conductive material, usually metal. Now referring to FIG. 2, a preferred embodiment of a metal connector 100 is disclosed, typically produced by progressive die stamping, as is known in the prior art. Slot 110 is configured to accommodate magnet wire 115 and slot 140 is configured to accommodate lead wire 145. Slot 110 comprises a small cantilever blade 120, which keeps a spring load on magnet wire 115 as the slot slides across the magnet wire 115. The sliding action cuts and abrades away the film of insulation surrounding the magnet wire, allowing a gas tight, spring loaded contact of wire 115 between the slot edge 111 of slot 110 and opposing blade edge 121 of blade 120. Blade 120 is preferably manipulated into this cantilever configuration by the method described below. Blade 120 is initially stamped in a position remote of slot edge 111. It is manipulated toward the slot edge 111 of slot 110 such that it becomes an unloaded spring, at rest adjacent to slot edge 111. When magnet wire 115 is inserted between blade edge 121 and the slot edge 111, the force from the insertion serves to spring load the blade, which in turn places fore upon magnet wire 115. This helps to displace the insulation from magnet wire 115 and to maintain an effective, gas tight mechanical and electrical contact between the edges and the wire.

At the same time, lead wire slot 140, via blades 150, cuts and spreads the insulation of lead wire 145 and allows penetration, a gas tight contact and squeeze of the outer strands of lead wire 145 conductor. Cavity 160 provides an area where the displaced insulation from lead wire 145 can collect when the lead wire is inserted into slot 140. This configuration reduces the force that bunched up insulation would place on lead wire 145 to move toward the open end of slot 140, helping to prevent inadvertent removal of the lead wire 145 from slot 140. This configuration also reduces the force that bunched up insulation would place on connector 100 itself, which could contribute to distortion of the configuration of connector 100.

In a preferred embodiment, connector 100 further comprises wedges 170 and 180. In this embodiment, wedges 170 and 180 are oriented between the ends 198 and 199 of connector 100 toward the end 199 adjacent to slots 110 and 140. Wedges 170 and 180 provide mechanical catches or stops to prevent overinsertion of connector 100 into its mounting medium, preventing deformation of end 199 of the connector 100 adjacent to slots 110 and 140. Wedges 170 and 180 also provide added stability to the remainder of connector 100, acting to prevent slippage and inadvertent removal of connector 100 by mechanically catching the mounting medium and adding surface area that is in contact with the mounting medium, increasing friction between the medium and the connector.

Figure 3A:
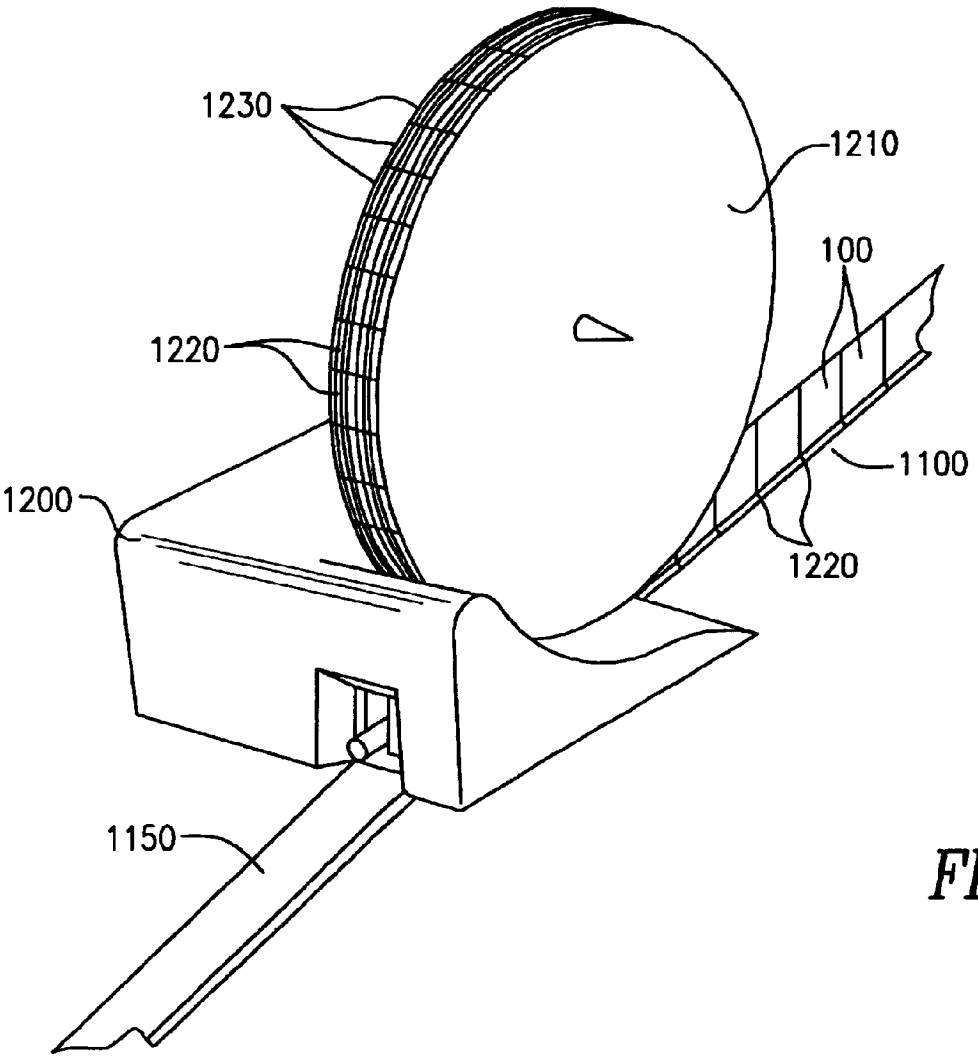
FIG. 3A is a perspective view of an embodiment of performing a method of electrical connector production of the present invention.

Now referring to FIG. 3, a preferred embodiment of a method for providing a plurality of connectors is disclosed, said plurality of connectors joined top to bottom, into a continuous strip 1100. The separation of connectors 100 of the strip 1100 can be achieved without producing any scrap "knock outs," that is pieces of material between each individual connector 100. In a preferred embodiment, connectors 100 are die stamped from blank material 1150 on a rolling die press 1200, as illustrated in FIG. 3A. Rolling die press 1200 has a rotary die 1210, which is comprised of multiple individual dies 1220 in the configuration of connectors 100, arranged top to bottom around the circumference of the rotary die 1210. Between the top and bottom of each of these individual dies 1220, is located a thin indentation 1230. The blank material 1150 is fed into rolling die press 1200. Rotary die 1210 repeatedly stamps connector 100 and a slight indentation 1250 into the material. This creates scrap material in the various cavities of the connectors 100, but does not create any scrap material between the connectors 100. The resulting stamped material is strip 1100. Strip 1100 can be stored in high capacity reels.

Now referring to FIG. 3, a preferred embodiment of a method of high volume automatic assembly of connectors 100 into bobbins 20 is disclosed. Strips 1100 of connectors 100 are fed from high capacity reels into slots 24 of bobbins 20 containing magnet wires 30 and lead wires 40. This causes connector 100 to electrically engage and connect magnet wires 30 and lead wires 40. The individual connectors 100 are then snapped off at indentations 1250. The completed bobbin 20 with wire connector 100 is then removed and the process is repeated.

For very low volume, such as prototype or pilot production, the individual connector 100 can be neatly applied using the following preferred embodiment of the present invention. Each connector 100 in strip 1100 is simply snapped off at indentation 1250 and applied using hand pliers positioning and hand press technique.

Figure 2:
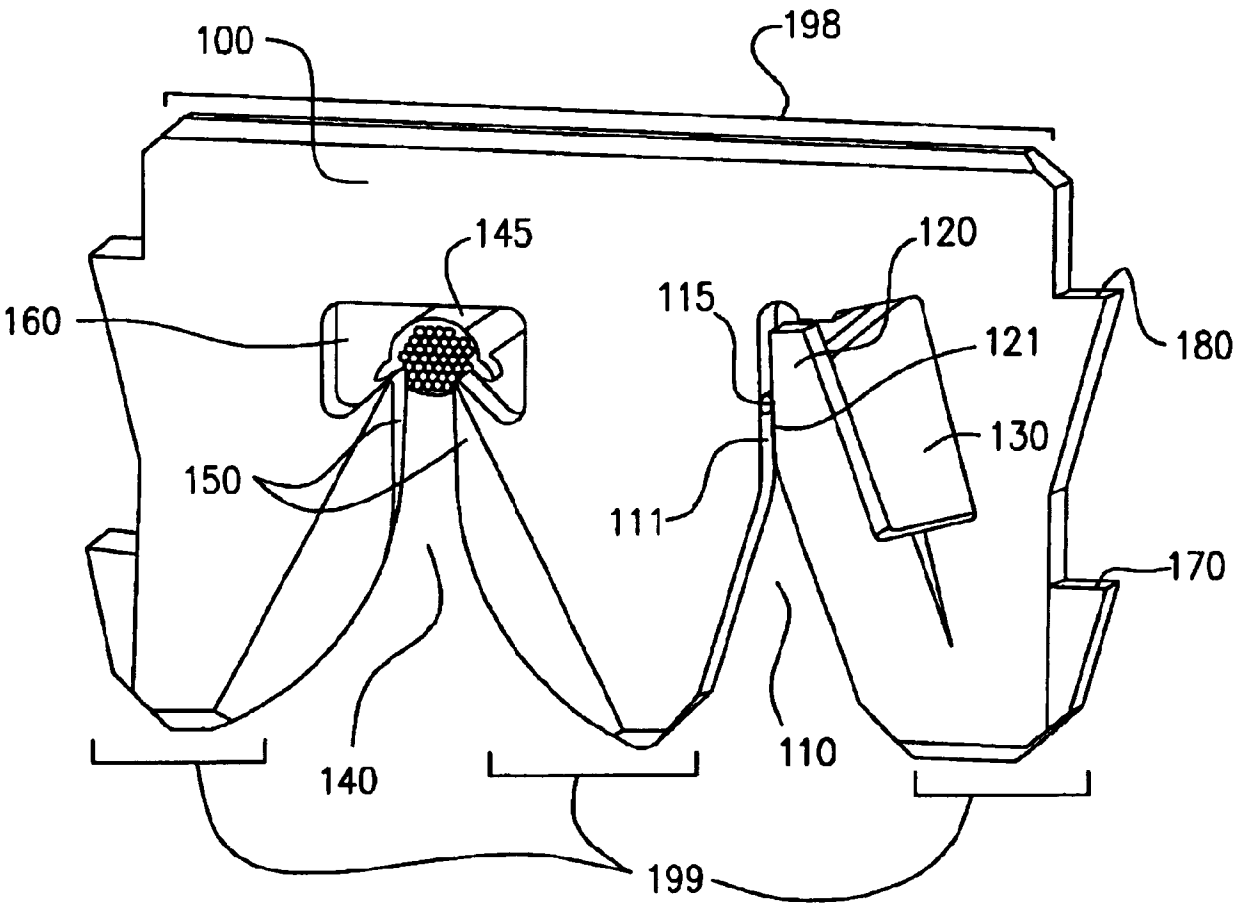
FIG. 2 is a front perspective view of a first embodiment of an electrical connector of the present invention.

Referring to FIGS. 2 and 3, a preferred embodiment of a method placing magnet wire 115 and lead wire 145 into connector 100 in one operation is disclosed. Magnet wire 115 and lead wire 145 are held in place, by a bobbin in the embodiment of FIG. 3, substantially parallel to each other and spaced apart substantially the same distance that the centerlines of slots 110 and 140 are spaced. Connector 100, aligned such that slots 110 and 140 are facing magnet wire 115 and lead wire 145, is then simply pushed onto magnet wire 115 and lead wire 145 until magnet wire 115 is positioned snugly in slot 110 and lead wire 145 is positioned snugly in slot 140, such that the insulation of magnet wire 115 and lead wire 145 is removed and both wires are in electrical contact with connector 100.

Figure 4:
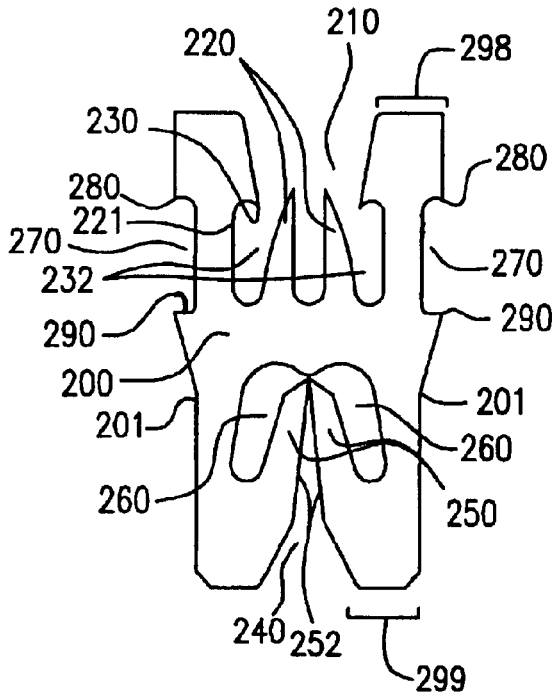
FIG. 4 is a front view of a second embodiment of an electrical connector of the present invention.

FIG. 4 illustrates yet another embodiment of the present invention wherein slots 210 and 220 are oriented in a direction substantially parallel and opposite to each other. Electrical connector 200 is a planar piece of conductive material, usually metal. Slot 210 is configured to accommodate a braided (stranded) lead wire that is insulated. Tang 220 protrudes from a closed end of slot 210 toward the open end of slot 210. Tangs 220 are sharp-edged and pointed to pierce the insulation of the lead wire. Now referring also to FIG. 8, this configuration also facilitates tangs 220 sliding in between the strands of the lead wire, providing an effective, gas tight electrical connection between connector 210 and the lead wire. Hook 230 is a protrusion from the lateral wall 221 of slot 210. It acts to retain the lead wire by mechanically catching the insulation of a lead wire in a fashion similar to a barbed fishing hook, allowing the insertion of the lead wire into slot 210 but catching it if removal of the same is attempted. Cavities 232 provide areas where the displaced insulation from the lead wire can collect when the lead wire is inserted into slot 210. This provides two advantages. It reduces the force that bunched up insulation would place on the lead wire to move toward the open end of slot 210 helping to prevent inadvertent removal of the lead wire from slot 210 It also reduces the force that bunched up insulation would place on connector 200 itself, which could contribute to distortion of the configuration of connector 200.

Figure 8:
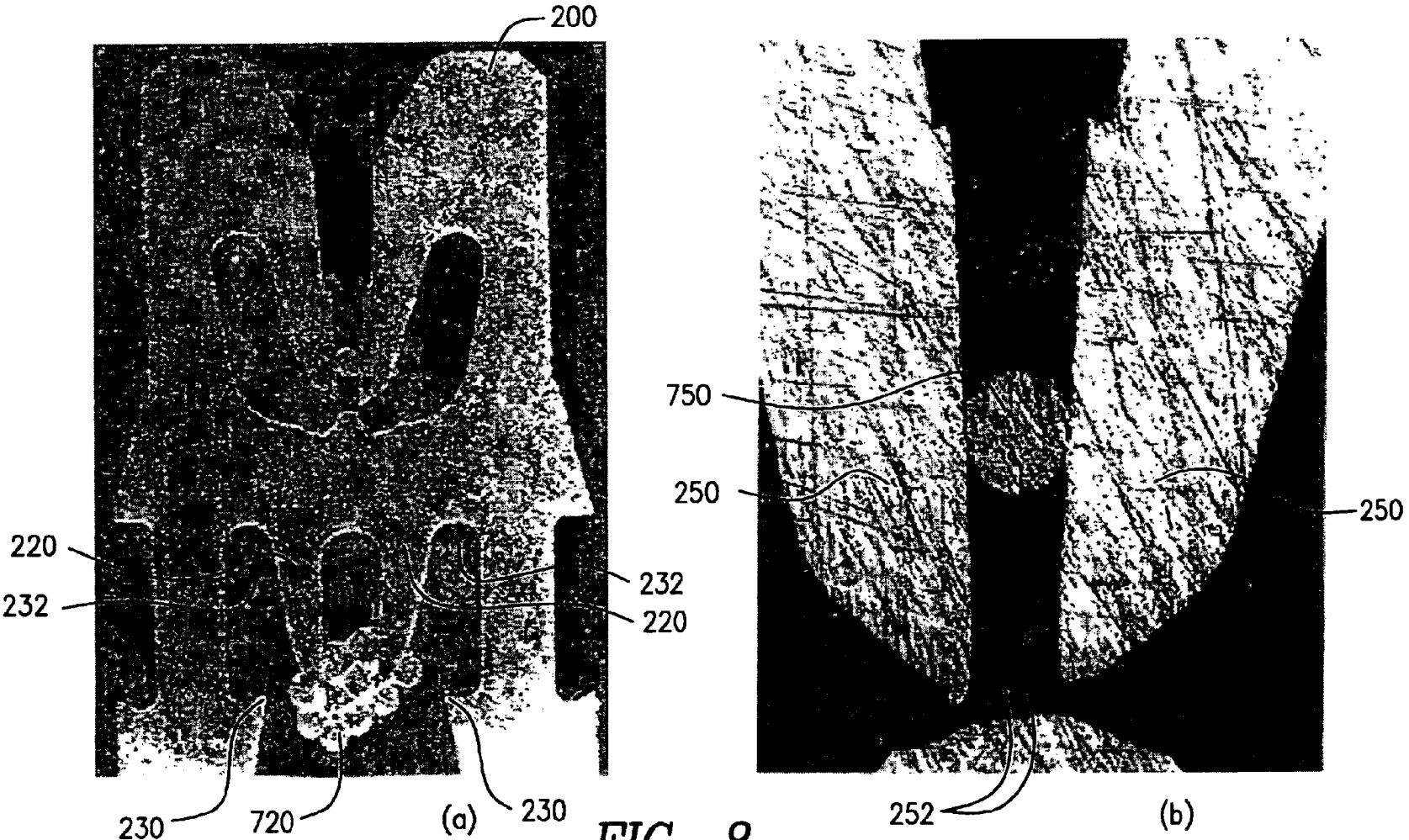
FIGS. 8*a* and 8*b* are front views of an embodiment of the present invention applied to a single strand magnet wire and multi-strand lead wire.

Slot 240 is configured to accommodate a magnet wire that is insulated. Blades 250 protrude from the lateral edges of slot 240 towards its closed end. Blades 250 are configured such that they approach each other and a centerline of slot 240, between the lateral edges 201 of connector 200. Blades 250 are manipulated into this configuration by the method described below. Blades 250 are initially stamped in a position remote of each other. They are manipulated toward blade lateral edges 252 of each other such that they become unloaded springs, at rest adjacent to each other. When magnet wire 222 is inserted between blade lateral edges 252, as illustrated in FIG. 8, the force from the insertion eves to spring load blades 250, which in turn places force upon magnet wire 750. This helps to displace the insulation from magnet wire 750 and to maintain an effective, gas tight mechanical and electrical contact between the edges 252 and wire 750. Edges 252 may also cut into the strand, providing added strength to the connection.

Each lateral edge 201 of connector 200 preferably further contains an indentation 270. The indentation 270 in a preferred embodiment further comprises hook 280. Indentation 270 and hook 280 provide an area for engaging connector 200 with a mounting medium, such as a plastic housing or a plastic bracket mounted on a printed circuit board such as those known in the art. Hook 280 provides two advantages in the mounting function. It provides a mechanical catch or stop to prevent overinsertion of connector 200 into its mounting medium, preventing deformation of the end of the connector adjacent to slot 240. Hook 280 also engages the mounting medium, especially where the mounting medium is constructed of plastic or another malleable material. This engagement stabilizes the lateral edge 201 of the connector, further preventing deformation of connector 200.

Connector 200 further preferably comprises wedges 290. In this embodiment, wedges 290 are aligned from the centerline of connector 200, between ends 298 and 299, toward end 299 adjacent to slot 240. Wedge 290 provides a mechanical catch or stop to prevent overinsertion of connector 200 into its mounting medium, preventing deformation of the end 299 of connector 200 adjacent to slot 240. Wedge 290 also provides added stability to the remainder of connector 200 and further acts to prevent slippage and inadvertent removal of connector 200 by mechanically catching the mounting medium and adding surface area that is in contact with the mounting medium, increasing friction between the medium and the connector.

Figure 4A:
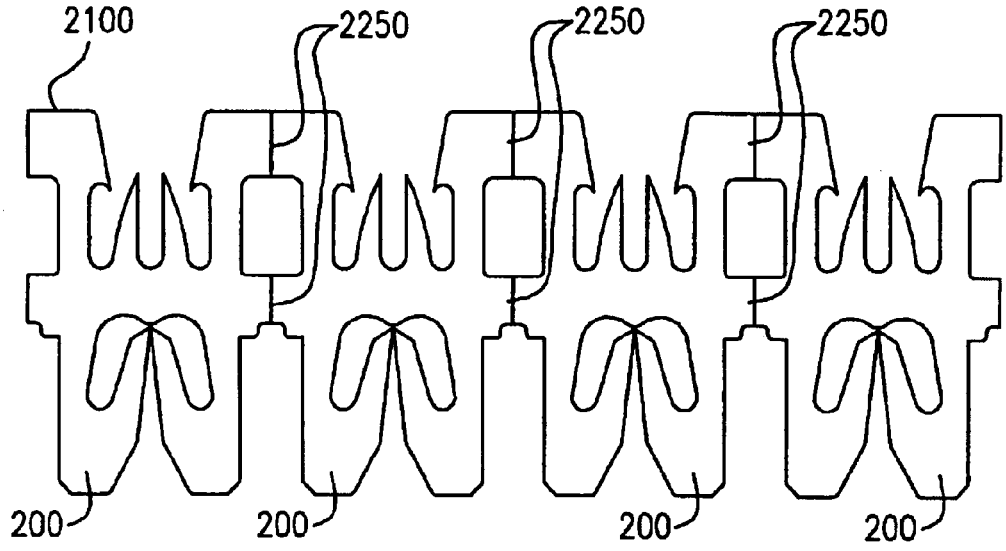
FIG. 4A is a front perspective view of a plurality of electrical connectors according to a second embodiment of the present invention.

Now referring to FIG. 4A, a preferred embodiment of a method for providing a plurality of connectors 200 is disclosed, said plurality of connectors joined wing to wing, into a continuous strip 2100. The separation of connectors 200 of the strip 2100 can be done along indentation 2250 without producing any scrap "knock outs," that is pieces of material between each individual connector 2100. The method of producing a plurality of connectors illustrated in FIG. 3A can be adapted to produce a plurality of connectors 200.

Referring to FIGS. 4 and 8(*a*), a preferred embodiment of a method placing magnet wire 750 and lead wire 720 into connector 200 is disclosed. Magnet wire 720 and lead wire 750 are held in place, substantially parallel to each other and spaced apart a distance greater than the length of lateral edge 201 of connector 200. Connector 200 is aligned along the shared centerline of both slots 210 and 240, such that slot 240 is facing magnet wire 750 and slot 210 is facing lead wire 720. Magnet wire 750 and lead wire 720 are then simply pushed together onto connector 200 until magnet wire 750 is positioned snugly in slot 240 and lead wire 720 is positioned snugly in slot 210 such that the insulation of magnet wire 750 and lead wire 720 is removed and both wires are in electrical contact with connector 200.

Figure 4C:
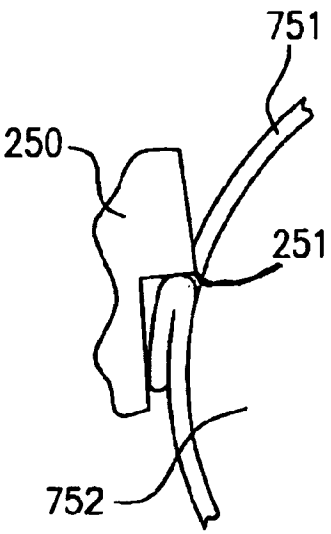
FIG. 4C is a front view of another blade embodiment of the second embodiment of an electrical connector of the present invention.
Figure 4B:
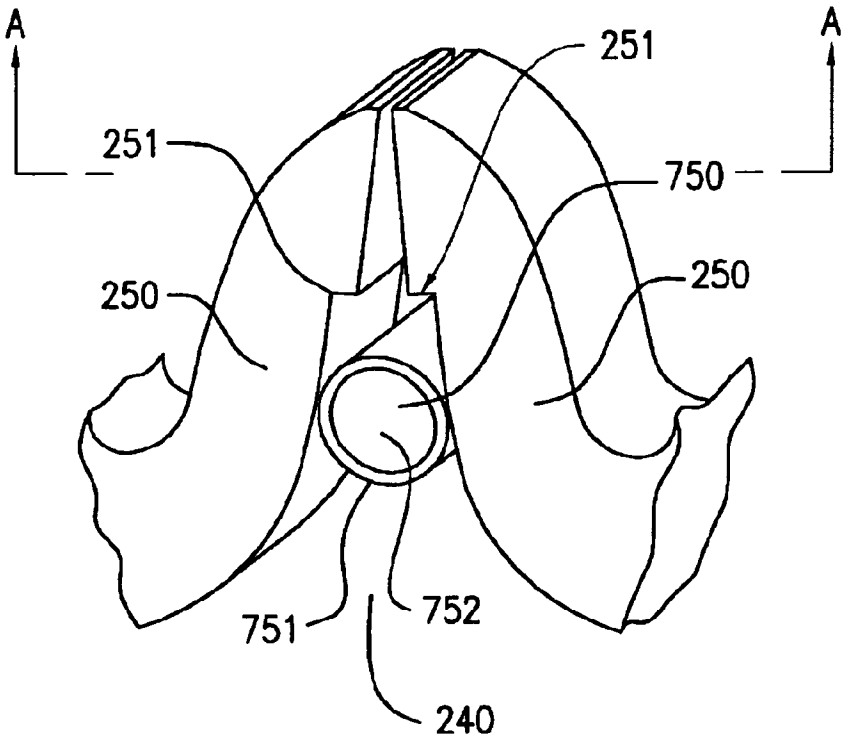
FIG. 4B is a front perspective view of another blade embodiment of the second embodiment of an electrical connector of the present invention.

FIGS. 4B and 4C illustrates an embodiment of connector 200, further comprising blades 250 having sharp notches 251. Notches 251 engage insulation 751 of magnet wire 750 when it is inserted into slot 240 and cut through and peel insulation 751 such that blades 250 can electrically connect with conductor 752 of magnet wire 750.

Figure 7:
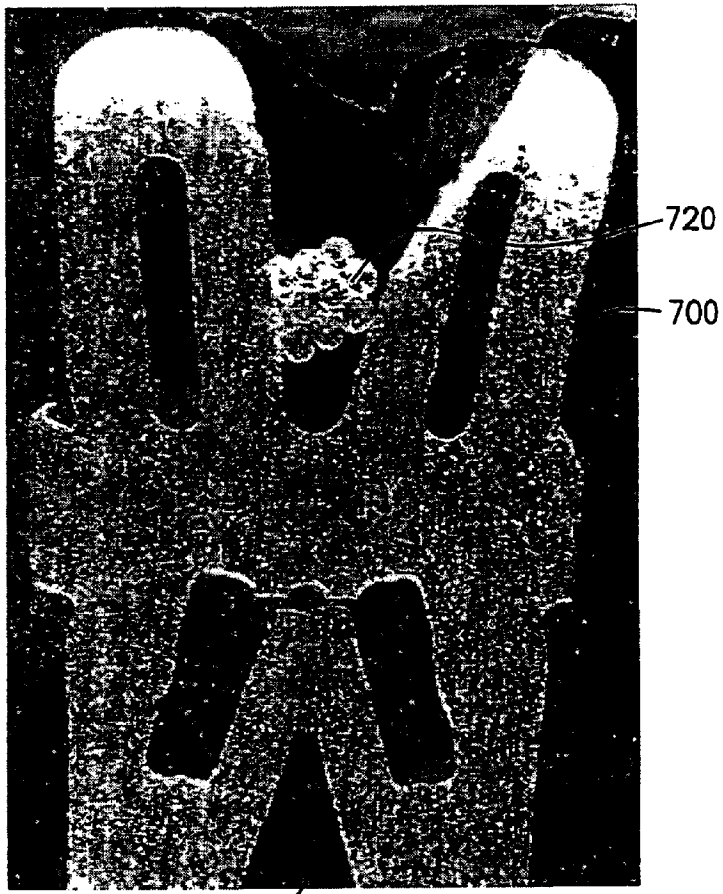
FIG. 7 (PRIOR ART)
FIGS. 7*a* and 7*b* are front views of a prior art electrical connector applied to a single stand magnet wire and multi-strand lead wire.
Figure 7:
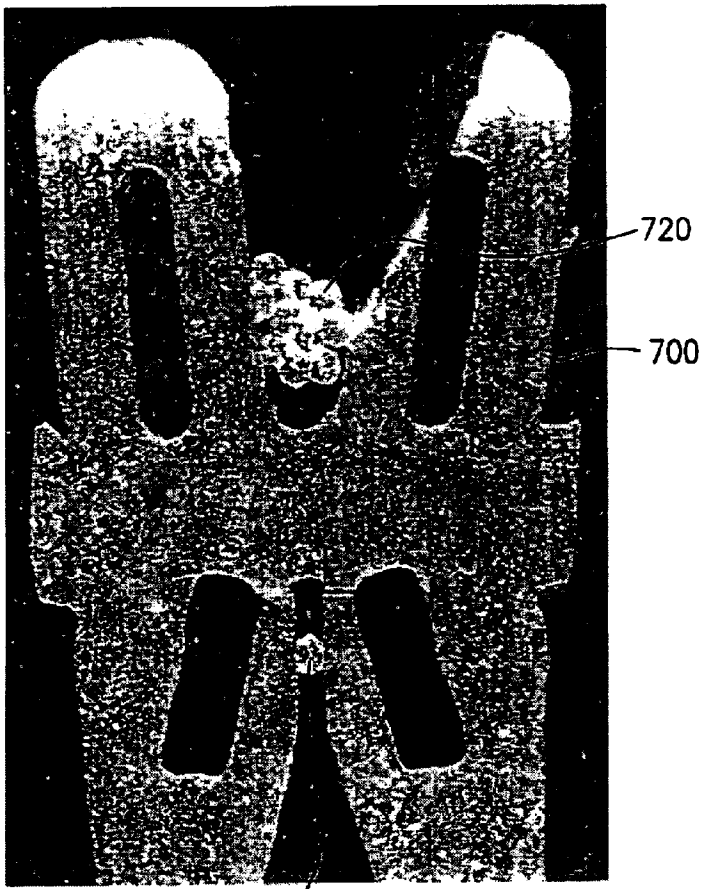
FIG. 7 (PRIOR ART)

FIGS. 7*a*, 7*b*, 8*a* and 8*b* illustrate some of the advantages provided by the present invention over the prior art. FIGS. 7*a* and 7*b* show a prior art electrical connector 700 for connecting multi-strand lead wire 720 and single strand magnet wire 750. The lead wire 720 stands are bunched together and distort the edge of the connector slot. This results in a relatively poor connection and in little friction between the slot edges and lead wire 720. Meanwhile, the insulation of lead wire 720 bunches up and has no place to go. This results in the insulation pushing lead wire 720 toward the open end of the slot, which leads to the inadvertent removal of the lead wire 720.

Regarding single strand magnet wire 750, FIG. 7*a* shows the magnet wire connected by the prior art connector in a typical manner. However, FIG. 7*b* shows a poor connection between the magnet wire 750 and the connector, resulting from distortion in the connector 700 and less than desirable tolerances in the dimensions of the blades connected to the magnet wire.

FIGS. 8*a* and 8*b* illustrate an embodiment of the present invention configured to connect lead multi-strand lead wire and single strand magnet wire. FIG. 8*a* shows the connection between the strands of the lead wire 720 and tangs 220 of the connector 200. Tangs 220 slide in between the strands of the lead wire, providing a large surface area to establish effective, gas tight electrical and mechanical (frictional) contact. Connector 200 including tangs 220 is also appropriate for use with a solid lead wire, wherein the solid lead wire is fittingly placed between tangs 220 (not illustrated). Cavities 232 allow the insulation of the lead wire 720 to collect without applying outward pressure on lead wire 720, thus preventing inadvertent removal. Hooks 230 provide further impediments to inadvertent wire removal by grasping into the insulation of lead wire 720 when the wire is forced outward, acting like a barbed fishing hook.

FIG. 8*b* shows the connection between the connector and the magnet wire 750, via blades 250. Thanks to the manipulation of blades 250 using the methods described below, the connection between blades 250, via blade lateral edges 252, and magnet wire 750 is a more effective, gas tight and precise mechanical and electrical connection based upon a spring load, especially when smaller diameter wire is used, than has been heretofore economically practicable.

Figure 4D:
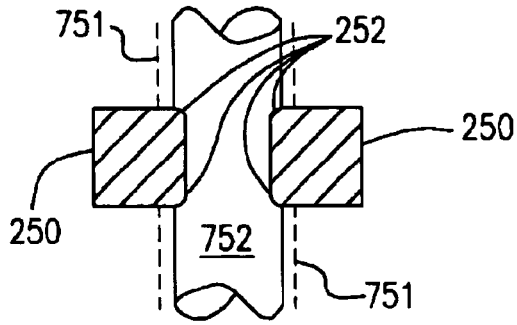
FIG. 4D is a front view of a further blade embodiment of the second embodiment of an electrical connector of the present invention.

FIG. 4D illustrates a further embodiment of connector 200, further comprising lades 250 having blade lateral edges 252 containing rounded edges. FIG. 4D shows a cross-sectional view of blade 250, through a line A—A, and includes magnet wire 750 placed between lateral edges 252. Magnet wire 750 comprises insulation 751 and conductor 752.

Figure 4E:
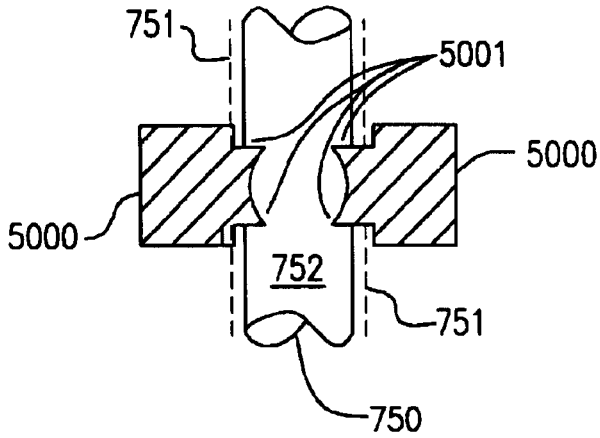
FIG. 4E (PRIOR ART)
FIG. 4E is a font view of a prior art blade embodiment.
Figure 4F:
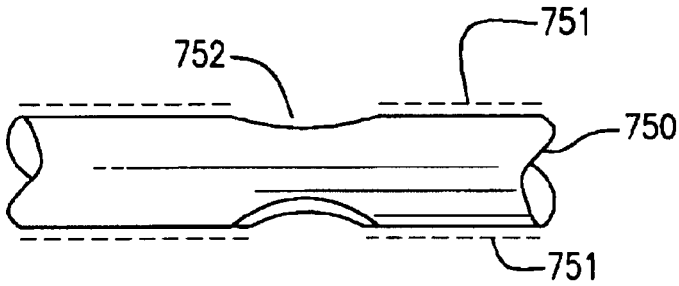
FIG. 4F is a front view of a magnet wire acted upon by a further blade embodiment of the second embodiment of an electrical connector of the present invention.
Figure 4G:
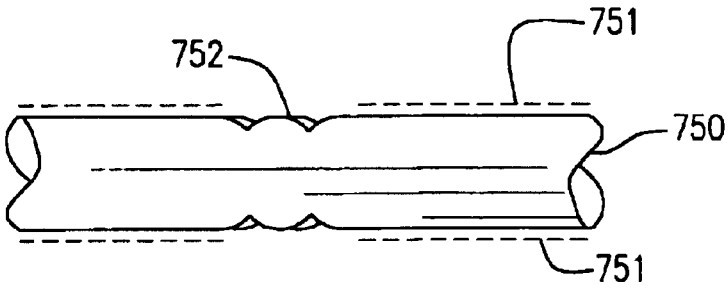
FIG. 4G (PRIOR ART)
FIG. 4G is a front view of a magnet wire acted upon by a prior art blade embodiment.

FIG. 4E illustrates a prior art blade configuration 5000 having pointed blade edges 5001. This configuration contains the drawback of cutting deeply into conductor 752. This results in a weakening of magnet wire 750 FIG. 4G shows conductor 752 after it has been connected to a prior art blade configuration. Conductor 752 is deeply notched and is substantially weakened structurally.

Referring back to FIG. 4D in the present embodiment rounded edges 252 prevent blades 250 from substantially cutting into conductor 752. FIG. 4F shows magnet wire 750 after it has been connected to the blades of the present embodiment. Conductor 752 is only lightly abraded and maintains its structural strength.

Figure 9:
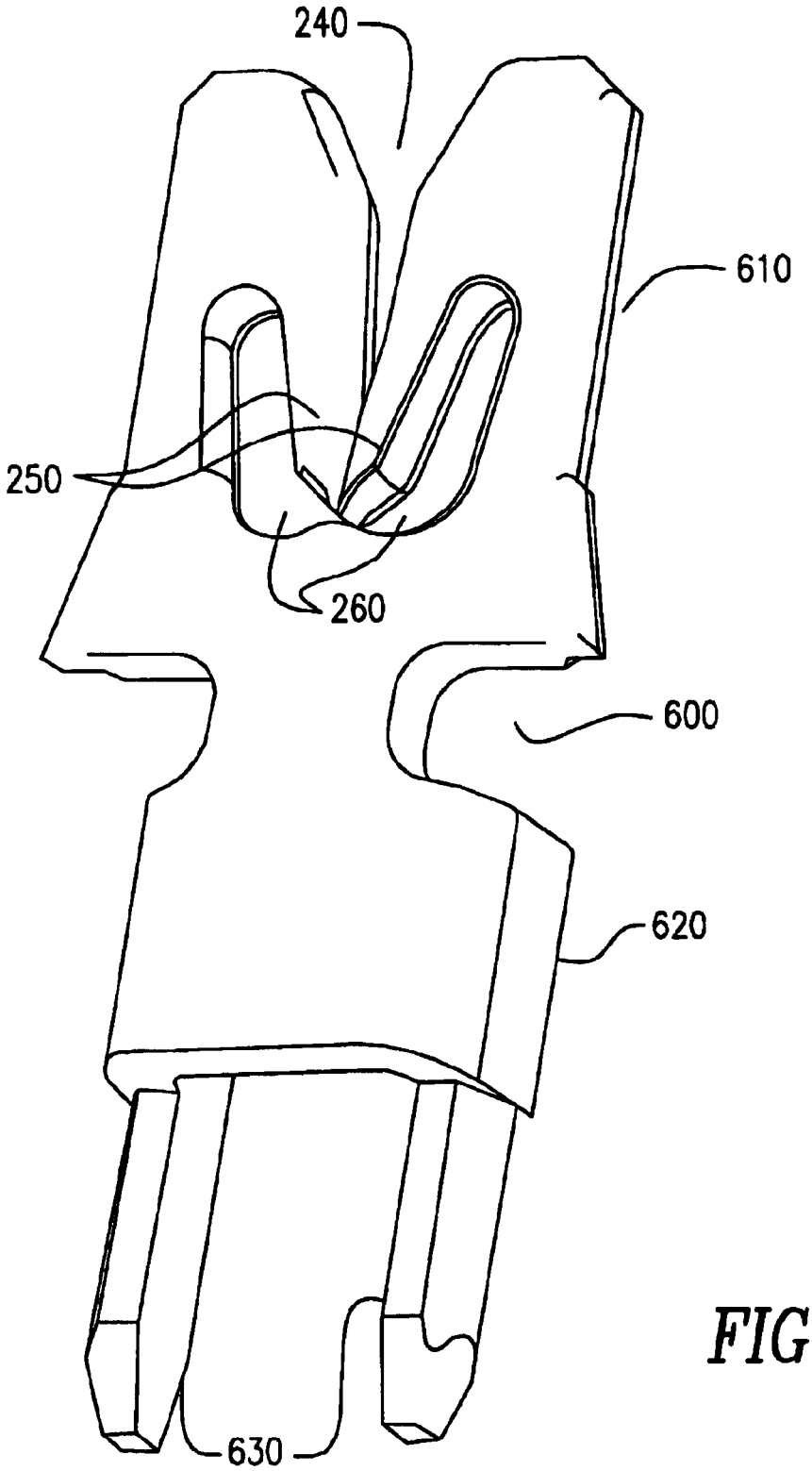
FIG. 9 is a front perspective view of a third embodiment of an electrical connector of the present invention.

FIG. 9 illustrates still another embodiment of an electrical connector of present invention and demonstrates how the conductors connected using the present invention are not limited to wires. Connector 600 is adapted to connect a lead wire with a printed circuit board (PCB). Electrical connector 600 is a piece of conductive material, usually metal. Wire portion 610, comprising slot 240, blades 250 and cavities 260, is adapted to mechanically and electrically connect to a lead wire in a manner similar to that of the connector illustrated in FIGS. 4 and 8(*a*), described in depth above. PCB portion 620 is adapted to mechanically and electrically connect to connection holes in a printed circuit board, which is known in the prior art. Prongs 630 are configured a dimension to snugly fit into the holes of a printed circuit board.

Figure 9A:
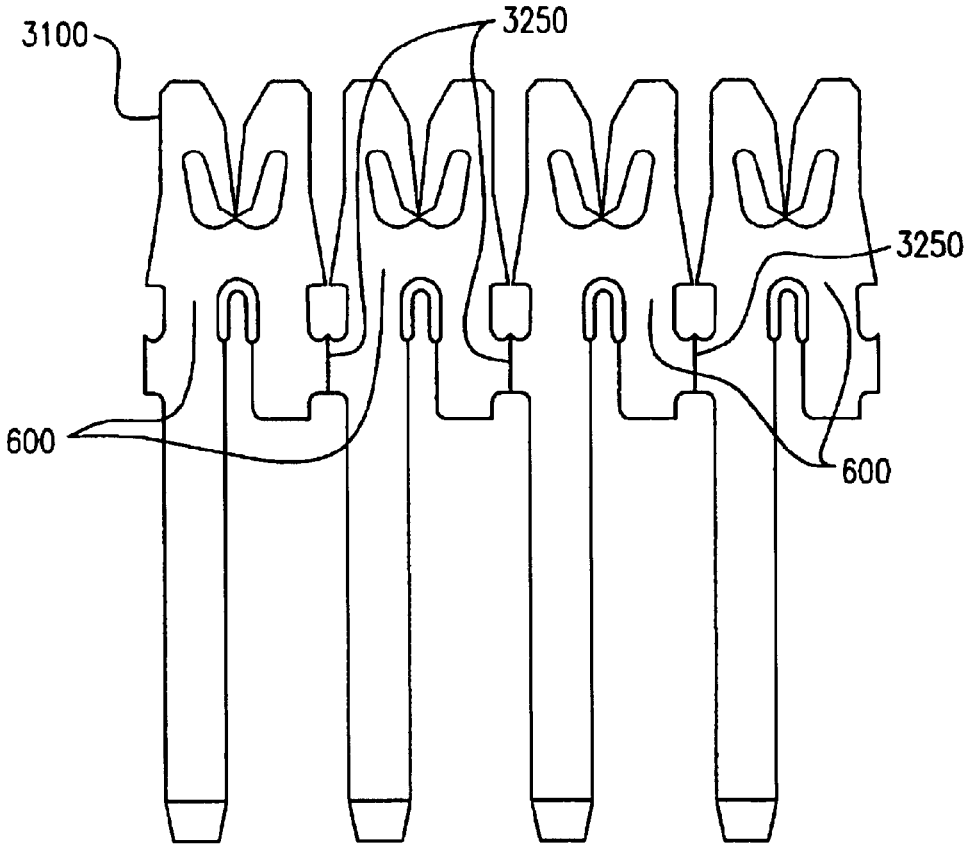
FIG. 9A is a front perspective view of a plurality of electrical connectors according to a third embodiment of the present invention.

Now referring to FIG. 9A, a preferred embodiment of a method for providing a plurality of connectors 600 is disclosed, said plurality of connectors joined wing to wing, into a continuous strip 3100. In this embodiment, connectors 600 are adapted to connect a lead wire to a PCB hole, similar to the embodiments of connector 600 in FIGS. 9A. The separation of connectors 600 of the strip 3100 can be done along indentation 3250 without producing any scrap "knock outs," that is pieces of material between each individual connector 3100. The method of producing a plurality of connectors illustrated in FIG. 3A can be adapted to produce a plurality of connectors 600.

Figure 10:
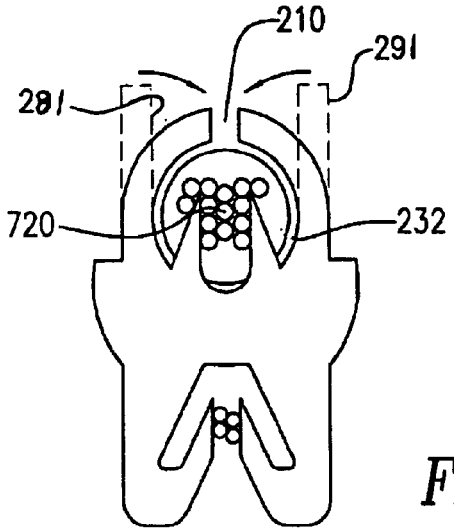
FIG. 10 is a front view of a fifth embodiment of an electrical connector of the present invention.

FIG. 10 illustrates a further embodiment of those electrical connector embodiments of the present invention that are adapted to accommodate a lead wire, FIGS. 4, 8(*a*). Wings 291 are each loosely defined by slot 210, cavity 232 and adjacent lateral edge 281. Lead wire 720 is positioned snugly into slot 210 such that its insulation is removed and it is in electrical contact with connector 200. Then, wings 291 are bent around lead wire 720 positioned in slot 210, creating a door-like stop for retaining and entrapping lead wire 720 and preventing its inadvertent removal.

Method of Manipulating Blade

Traditionally, electrical connectors in the art of the present invention have been manufactured by die stamping them from a sheet of conductive material.

Figure 5:
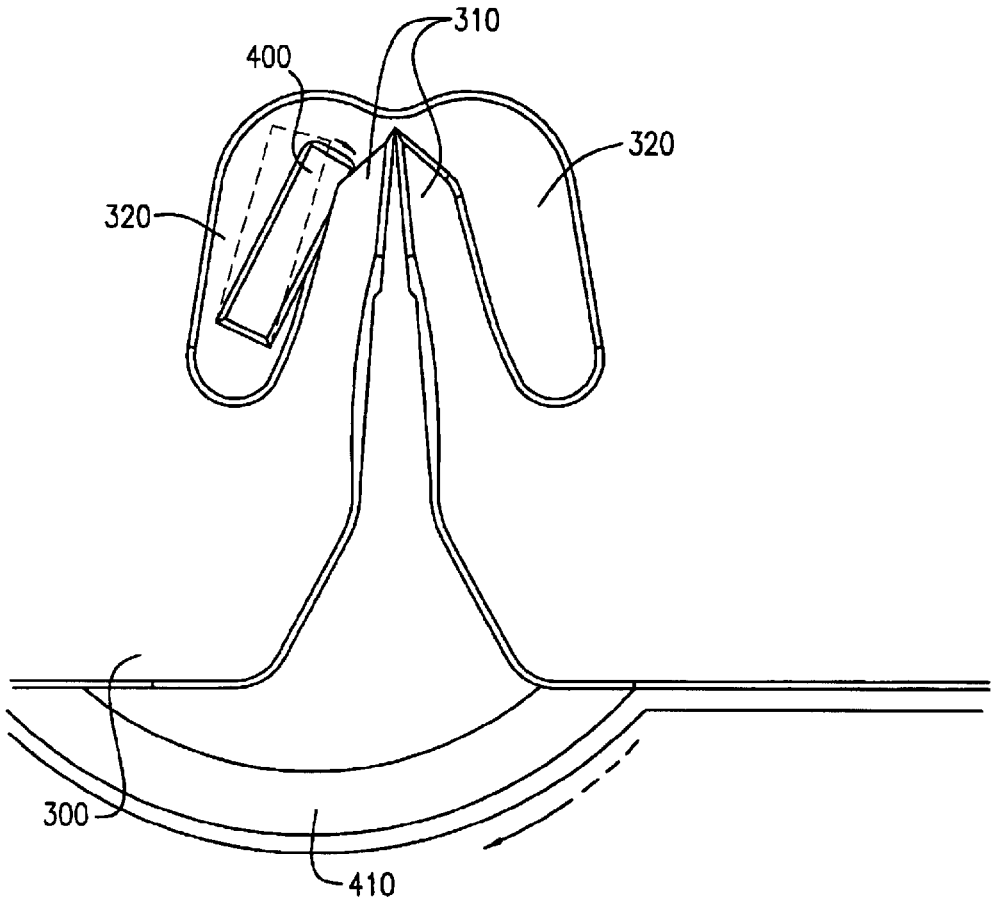
FIG. 5 is a top view of an embodiment of performing a method of electrical connector manipulation of the present invention.

As shown in FIG. 5, connector 300 comprises blades 310 for mechanically and electrically connecting to a magnet wire of very small diameter, 0.010" for instance. Connector 300 is stamped out of the material sheet in the configuration as shown, providing elements including blades 310, and cavities 320 adjacent to each blade 310. Under conventional stamping techniques, blades 310 can only be stamped to a certain small dimension and a certain distance from an opposing blade or a slot wall, depending upon variables such as stamping equipment and material used. Stamping any smaller or any closer than the variables allow, results in broken or weak blades that will not function properly. The present invention solves this problem by stamping blades remote from each other and then manipulating them into a desired configuration using a tool.

Figure 6:
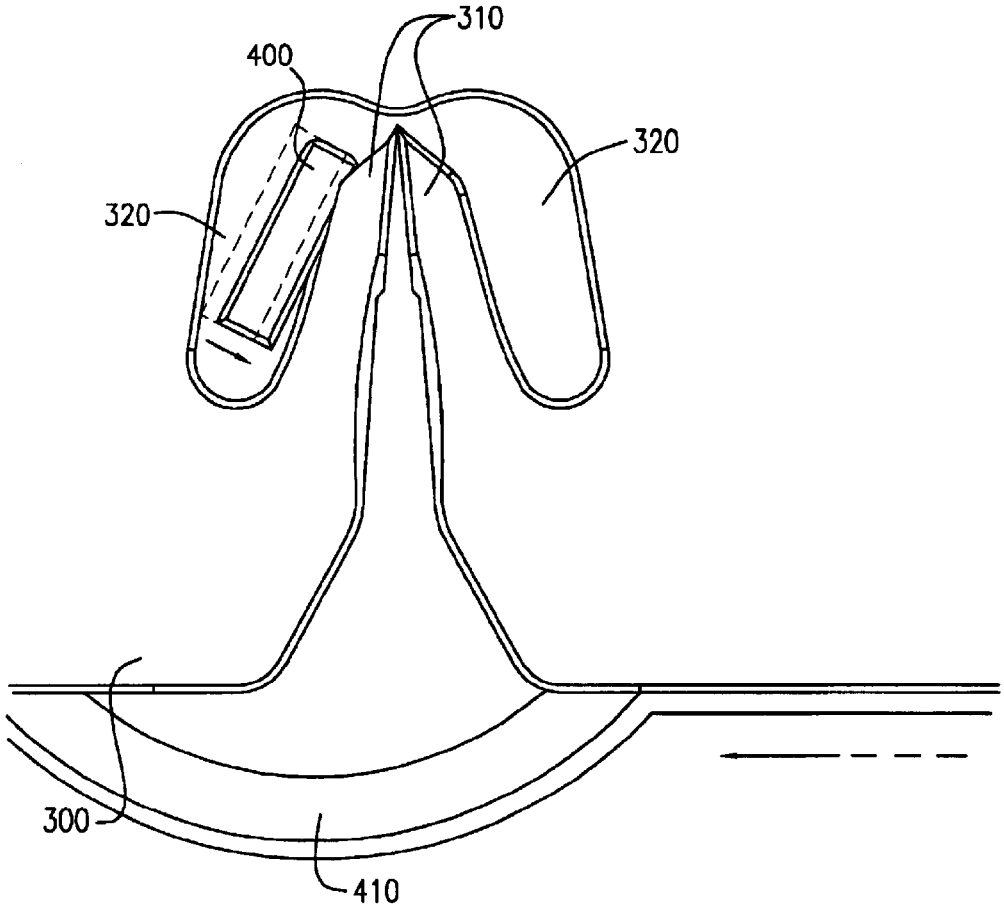
FIG. 6 is a top view of another embodiment of performing a method of electrical connector manipulation of the present invention.

According to one preferred embodiment a method is provided is provided wherein connector 300 is positioned about tool 400, with tool 400 positioned within cavity 320. Tool 400 is mounted on a movable base 410. Tool 400 is then moved against blade 310 by movable base 410. Movable base continues to move tool 400 and blade 310 until blade 310 is manipulated into the desired position. Connector 400 is then removed from tool 400. The process may be repeated on further blades of the connector. Movable base 400 may move in any desired direction, including arching, linear (see FIG. 6) or a more complex motion. In an alternate embodiment, this method may be employed such that the connector 300 is moved about a fixed tool 400 to manipulate blade 310, instead of tool 400 being moved via movable base 410.

This method can be applied to the blades of any electrical connector where extremely small close tolerances are necessary to facilitate proper connection to wires of very small diameters. This includes blades 120 of connector 100, using cavity 130; and blades 250 of connector 200 using cavities 260.

In the following, the patent claims will be given, and the various details of the invention can show variation within the scope of the inventive idea defined in the claims and differ even to a considerable extent from the details stated above by way of example only. As such, the examples provided above are not meant to be exclusive and many other variations of the present invention would be obvious to those skilled in the art, and are contemplated to be within the scope of the appended claims.

I claim:

1. An electrical connector comprising:

a substantially planar body;

at least a first slot formed in the planar body and oriented in a selected direction;

said first slot adapted to conductively engage a first wire inserted therein; at least a second slot formed in the planar body and oriented in a direction substantially parallel and opposite to the selected direction; and said second slot adapted to conductively engage a second wire inserted therein;

said first slot comprising an open end, a closed end and at least two opposing walls and at least one tang extending from the closed end toward the open end, said tang having an end not attached to either of said walls and adapted to conductively engage said wire;

said second slot comprising an open end, a closed end and opposing walls, with at least two blades with free ends protruding from the open end toward the closed end, such that each blade forms a cavity between itself and the wall;

wherein the free ends of the blades are not attached to the closed end of the second slot;

whereby insertions of the first wire and the second wire through the first and second slot establishes electrical contact with one another through the planar body.

2. An electrical connector according to claim 1, at least one slot adapted to displace insulation when a wire is inserted therein.

3. An electrical connector of claim 1, said at least one tang comprising two tangs.

4. A method of using an electrical connector of claim 3, comprising placing a wire having a single conductive strand and an insulative covering in between said two tangs, such that the tangs pierce the insulative covering and become electrically connected to said single conductive strand.

5. A method of using an electrical connector of claim 3, comprising placing a wire having multiple conductive strands and an insulative covering about said two tangs, such that said tangs pierce the insulative cover and multiple conductive strands are disposed about a surface of each said tang, become electrically connected to each said tang.

6. An electrical connector of claim 1, said walls being movably adaptable about said wire.

7. A method of manipulating walls of an electrical connector of claim 1 comprising the steps of placing at least one wire into said at least one slot and bending said opposing walls about said wire such that it is retained in the slot.

8. An electric connector of claim 1, at least one of said walls comprising a protrusion toward the opposite wall.

9. An electric connector of claim 8, said protrusion comprising a hook.

10. An electrical connector of claim 1, said blades having a notch located along a length adjacent to an opposite blade.

11. An electrical connector of claim 1, said blades adapted to be manipulated toward each other such that each blades is capable of maintaining a spring load.

12. A method of manipulating blades of an electrical connector of claim 1, comprising the steps of placing a tool in a cavity formed between a blade and an opposing wall; and moving the tool such that it engages the blade and manipulates it toward an opposite wall.

13. The method of claim 12, comprising moving the tool in a substantially linear direction.

14. The method of claim 12, comprising moving the tool in an arching motion.

15. The method of claim 12, comprising moving the electrical connector about the tool such that the blade engages the tool which manipulates the blade toward an opposite wall.

16. The method of claim 15, comprising moving said connector about the tool in a substantially linear direction.

17. The method of claim 15, comprising moving said connector about the tool in an arching motion.

18. The electrical connector of claim 1, said connector further comprising two lateral edges and two ends, each end being adjacent to one of said slots.

19. The electrical connector of claim 18, said second slot oriented in a direction substantially parallel and opposite to the selected direction.

20. The electrical connector of claim 19, the closed end of the first slot adjacent to the closed end of the second slot.

21. The electrical connector of claim 19, at least one lateral edge further comprising at least one indentation adjacent to one of said slots.

22. The electrical corrector of claim 21, wherein the indentation contains a lateral edge that is adjacent to an end and hooked toward an opposite end.

23. The electrical connector of claim 19, at least one lateral edge further comprising a protrusion located between the two ends.

24. The electrical connector of claim 23, at least one protrusion located substantially about a centerline between the two ends.

25. The electrical connector of claim 21, at least one lateral edge further comprising a protrusion located between the indentation and the end adjacent to the opposing slot.

26. The electrical connector of claim 25, wherein the protrusion is located substantially about a centerline between the two ends.

27. An electrical connector comprising:

a substantially planar body;

at least a slot formed in the planar body and oriented in a selected direction;

said slot adapted to conductively engage a wire inserted therein;

at least a prong formed in the planar body and oriented in a direction substantially parallel and opposite to the selected direction; and said prong adapted to conductively engage a printed circuit board to which it is inserted;

said slot comprising an open end, a closed end and opposing walls, with at least two blades with free ends protruding from the open end toward the closed end, such that each blade forms a cavity between itself and the wall;

wherein the free ends of the blades are not attached to the closed end of the second slot;

whereby electrical contact between the wire and the printed circuit board is established through the planar body.

28. A strip of at least two electrical connectors comprising for connecting two wires:

a strip of conductive material stamped into at least two electrical connectors;

said connectors directly adjacent to each other such that there are no pieces of material between them that are not part of one of said connectors;

wherein the connector is a substantially planar body comprising:

at least a first slot formed in the planar body and oriented in a selected direction to engage the first wire therein; and at least a second slot formed in the planar body and oriented in a direction substantially parallel to the selected direction;

said first slot comprises an open end, a closed end and at least two opposing walls and at least one tang extending from the closed end toward the open end, said tang having an end not attached to either of said walls;

said second slot comprising an open end, a closed end and opposing walls, with at least two blades with free ends protruding from the open end toward the closed end, such that each blade forms a cavity between itself and the wall;

wherein the free ends of the blades are not attached to the closed end of the second slot.

29. A method for placing at least two wires into an electrical connector containing at least two slots oriented in a direction substantially parallel and opposite to each other, comprising the steps of:

placing said at least two wires substantially parallel to each other;

spacing said at least two wires such that each wire is aligned with a slot of an electrical connector;

aligning said electrical connector such that each said slot is open toward said wires; and applying force to said connector in a direction of said wires;

the connector comprises a substantially planar body comprising:

at least one first slot comprising an open end, a closed end and at least two opposing walls and at least one tang extending from the closed end toward the open end, said tang having an end not attached to either of said walls;

at least one second slot comprising an open end, a closed end and opposing walls with at least two blades with free ends protruding from the open end toward the closed end, such that each blade forms a cavity between itself and the wall;

wherein the free ends of the blades are not attached to the closed end of the second slot;

and inserting the respective wires into the respective slots whereby electrical contact with one another is established through the planar body.

30. A method for placing at least two wires into an electrical connector containing at least two slots oriented in a direction substantially parallel and opposite to each other, comprising the steps of:

placing said at least two wires substantially parallel to each other;

spacing said at least two wires such that each wire is aligned with a slot of an electrical connector;

aligning said electrical connector such that each said slot is open toward said wires;

and applying force to said wires in a direction of said connector;

wherein the connector is a substantially planar body comprising:

at least one first slot comprising an open end, a closed end and at least two opposing walls and at least one tang ending from the closed end toward the open end, said tang having an end not attached to either of said walls;

said second slot comprising an open end, a closed end and opposing walls, with at least two blades with free ends protruding from the open end toward the closed end, such that each blade forms a cavity between itself and the wall;

wherein the free ends of the blades are not attached to the closed end of the second slot; and inserting the respective wires into the respective slots such that the wires are in electrical contact with one another through the planar body.

31. A method for placing at least one wire and at least one printed circuit board into an electrical connector containing at least one slot and at least one prong oriented in a direction substantially parallel and opposite to each other, comprising the steps of:

placing said at least one wire substantially parallel to said at least one printed circuit board;

spacing said at least one wire such that it is aligned with the slot;

spacing said at least one printed circuit board such that it is aligned with the prong;

aligning said electrical connector such that said slot is open toward said at least one wire and such that said prong is extended toward said at least one printed circuit board;

and applying force to said wire and said printed circuit board in a direction to said connector;

wherein the connector is a substantially planar body comprising:

said prong;

said slot comprising an open end, a closed end and opposing walls, with at least two blades with free ends protruding from the open end toward the closed end, such that each blade forms a cavity between itself and the wall;

wherein the free ends of the blades are not attached to the closed end of the second slot; and inserting the wire into the slot establishing electrical contact with the printed circuit board through the planar body.

32. An electrical connector of claim 1, said blades having blade lateral edges containing rounded edges.

* * * * *